US007852141B2

(12) United States Patent
Walter

(10) Patent No.: US 7,852,141 B2
(45) Date of Patent: Dec. 14, 2010

(54) CIRCUIT ARRANGEMENT FOR SELECTIVE GENERATION OF AN ANALOG CURRENT OUTPUT VALUE OR AN ANALOG VOLTAGE OUTPUT VALUE

(75) Inventor: Heinz Walter, Hergatz (DE)

(73) Assignee: i f m electronic GmbH, Essen (DE)

( * ) Notice: Subject to any disclaimer, the term of this patent is extended or adjusted under 35 U.S.C. 154(b) by 66 days.

(21) Appl. No.: 11/157,994

(22) Filed: Jun. 22, 2005

(65) Prior Publication Data

US 2005/0280448 A1 Dec. 22, 2005

(30) Foreign Application Priority Data

Jun. 22, 2004 (DE) ..... 10 2004 030 161

(51) Int. Cl.
*G05F 1/10* (2006.01)
*G05F 3/02* (2006.01)

(52) U.S. Cl. ..... 327/538; 327/540

(58) Field of Classification Search ..... 327/51–52, 327/89, 108, 112, 561–563, 538, 50, 541, 327/543

See application file for complete search history.

(56) References Cited

U.S. PATENT DOCUMENTS 4,484,331 A * 11/1984 Miller ..... 372/34
5,783,956 A * 7/1998 Ooishi ..... 327/157
6,052,001 A * 4/2000 Cho et al. ..... 327/103
6,097,245 A * 8/2000 Dobbelaere et al. ..... 327/560
6,316,991 B1 * 11/2001 Muyshondt et al. ..... 327/543
6,624,685 B2 * 9/2003 Shih et al. ..... 327/541
6,842,058 B2 * 1/2005 McNitt et al. ..... 327/170

* cited by examiner

*Primary Examiner*—Quan Tra
(74) *Attorney, Agent, or Firm*—Roberts Mlotkowski Safran & Cole, P.C.; David S. Safran

(57) ABSTRACT

A circuit arrangement is described for selectively generating an analog current output value or an analog voltage output value as a function of an analog input value. Optionally, the analog current output value or the analog voltage output value may also be a function of an input base value or a signed input correction value. The circuit arrangement includes a current control unit, a voltage control unit, a current output source is triggered by the current control unit, and a voltage output source triggered by the voltage control unit. The current output source and voltage output source of the circuit arrangement may be triggered in parallel and are connected in series on the output side.

22 Claims, 2 Drawing Sheets

CIRCUIT ARRANGEMENT FOR SELECTIVE GENERATION OF AN ANALOG CURRENT OUTPUT VALUE OR AN ANALOG VOLTAGE OUTPUT VALUE

BACKGROUND OF THE INVENTION

1. Field of Invention

The invention relates to a circuit arrangement for selective generation of an analog current output value or an analog voltage output value as a function of an analog input value. Optionally, an input base value and/or a signed input correction value may also serve as inputs as well. The invention employs a current control unit, a voltage control unit, a current output source that is triggered by the current control unit, and a voltage output source that is triggered by the voltage control unit.

2. Description of Related Art

In the prior art, measuring devices are known that detect a physical quantity as a measured value. For example, temperature, pressure, flow rate, liquid level, or an electrical quantity, such as current, voltage or wattage, are detected and made available in the form of an analog measured value. The prior art has also known standardization of the measured values that are made available by the measuring devices of the aforementioned types, so that instead of the analog measured values which are made available or detected first, measured values that have been standardized for further processing in control circuits are available. Current values from 4 to 20 mA have been used as standardized measured values, as well as current values from 0 to 20 mA. Similarly, voltage values from 0 to 10 V have been extensively introduced in industrial practice as standardized measured values.

In conventional circuit arrangements for generating these types of output values, the current control unit and the voltage control unit are often made as operational amplifiers, while the current output source and the voltage output source generally include a transistor. Typically, the current output source operates with a Darlington transistor stage or with several Darlington transistor stages to keep the triggering base currents as low as possible.

Conventional circuit arrangements of this type have employed either a triggered current output source or a triggered voltage output source. The selective triggering of the current output source or the voltage output source has been previously accomplished using complex circuitry. In particular, past attempts included circuits requiring more than two operational amplifiers, with some circuits employing as many as four or five operational amplifiers to perform the selective triggering.

Consequently, what is needed is a circuit arrangement capable of providing standardized measured values and perform the selective triggering that can be built more easily and more economically than known circuit arrangements.

SUMMARY OF THE INVENTION

The circuit arrangement of the present invention achieves the desired functionality and is characterized by the current output source and the voltage output source triggered in parallel and connected in series on the output side. In a preferred embodiment of the circuit arrangement of the present invention, the current control unit and the voltage control unit are each made as operational amplifiers, and the current output source and the voltage output source each have one output transistor.

Additionally, there are a number of alternative embodiments detailed below for characterizing and developing circuit arrangements in accordance with the present invention.

According to another embodiment of the invention, to generate the current output value, the voltage output source is turned on, which means that the voltage output source, and an optional output transistor provided at the voltage output source, is conductive as an electronic switch.

Depending on the analog input value, the circuit arrangement of the present invention selectively generates an analog current value, called a current output value, or an analog voltage value, called a voltage output value. The generated current output value and the generated voltage output value may also be additionally dependent on an input base value and/or a signed input correction value as well as the analog input value.

The circuit of the present invention includes a current control unit and a voltage control unit. The analog input value and optional input base value and optional signed input correction value are sent to the input of the current control unit and the voltage control unit. The current control unit, in conjunction with the current output source, generates the analog current output value depending on the input value and the optional input base value and optional signed input correction value. Similarly, the voltage control unit, in conjunction with the voltage output source, generates the analog voltage output value.

If the circuit arrangement of the present invention is used to generate an analog current output value, the current that is made available from the current output source is that which flows via a load resistor as current that is essentially independent of the external load resistor. If the circuit arrangement of the present invention is used for generation of a voltage output value, the circuit arrangement on the voltage output source on the output side must make available the analog voltage output value essentially independently of the external load resistor. The internal resistance of the voltage output source, viewed from the outside, must therefore be small compared to the external load resistance. When the voltage output value is generated, therefore, the current output source makes available the load current that is flowing via the load resistor.

Another embodiment of the present invention is characterized by the voltage output source made as an in-phase controlling class A amplifier with an output transistor, a base resistor, and a pull-down resistor. In this embodiment of the circuit arrangement of the present invention, to generate the current output value, the pull-down resistor of the voltage output source, which may be made as a class A amplifier, is "run up" via a first series resistor so that the voltage control unit is overdriven up to a positive end stop, and the output transistor is conductively turned on via the base resistor. The voltage control unit in this embodiment may be made as an operational amplifier. To generate the voltage output value, the noninverting input of the operational amplifier that implements the voltage control unit is placed at the reference potential via a second series resistor and a conductive selector switch.

In the circuit arrangement of the present invention, a selector switch may be implemented to select and determine whether the current output value or the voltage output value is generated. For a nonconductive selector switch, a current output value is generated, while for a conductive selector switch, a voltage output value is generated.

The circuit arrangement for selective generation of an analog current output value or an analog voltage output value of the present invention may be achieved in a number of embodiments as depicted in the drawings and description of the invention.

BRIEF DESCRIPTION OF THE DRAWINGS

The above-mentioned and other features of this invention, and the manner of attaining them, will become more apparent, and the invention itself will be better understood, by reference to the following descriptions of the embodiments of the invention viewed in conjunction with the accompanying figures where.

DETAILED DESCRIPTION OF THE INVENTION

The circuit arrangement shown in the figures is used for selective generation of an analog current output value or an analog voltage output value as a function of an analog input value and an optional input base value and/or an optional signed input correction value. As shown schematically in FIG. 1, this circuit arrangement includes a current control unit 1, a voltage control unit 2, a current output source 3, which is triggered by the current control unit 1, and a voltage output source 4, which is triggered by the voltage control unit 2.

Figure 1:
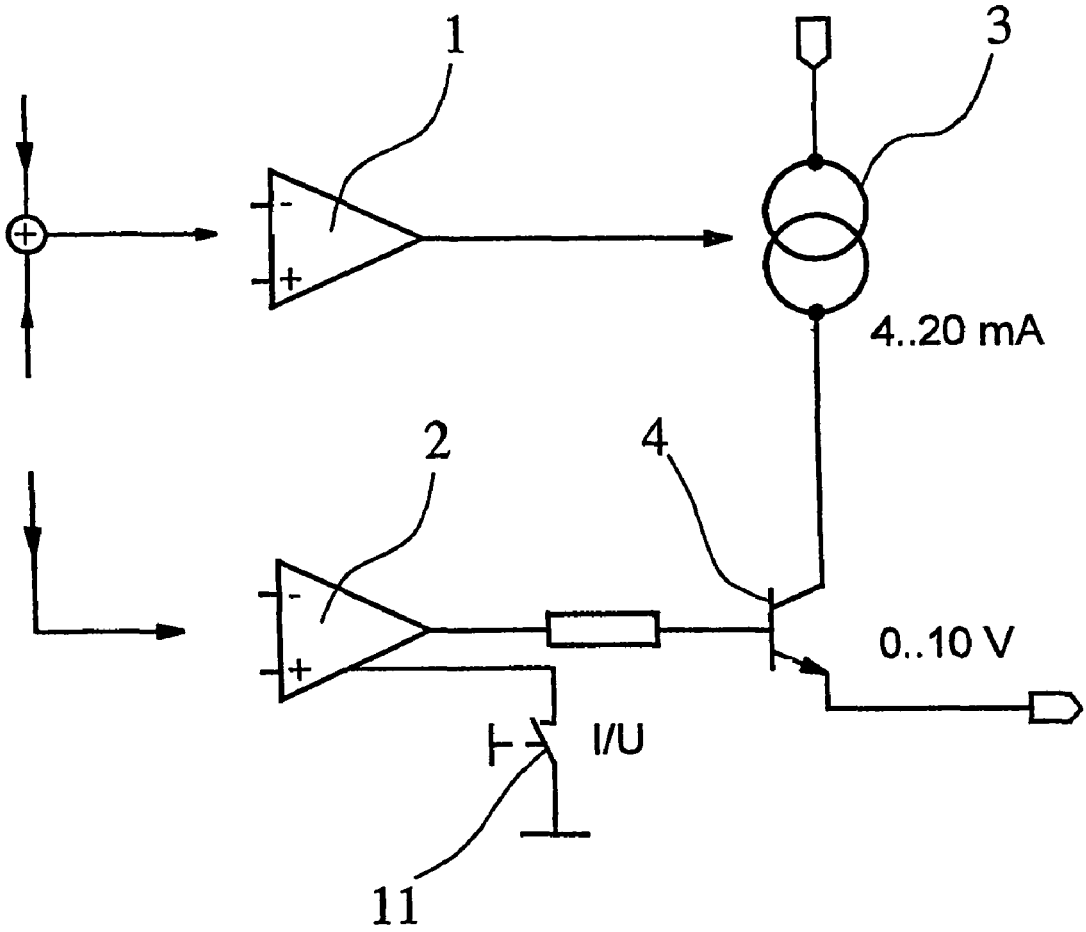
FIG. 1 shows a schematic diagram of a circuit arrangement in accordance with the present invention.
Figure 2:
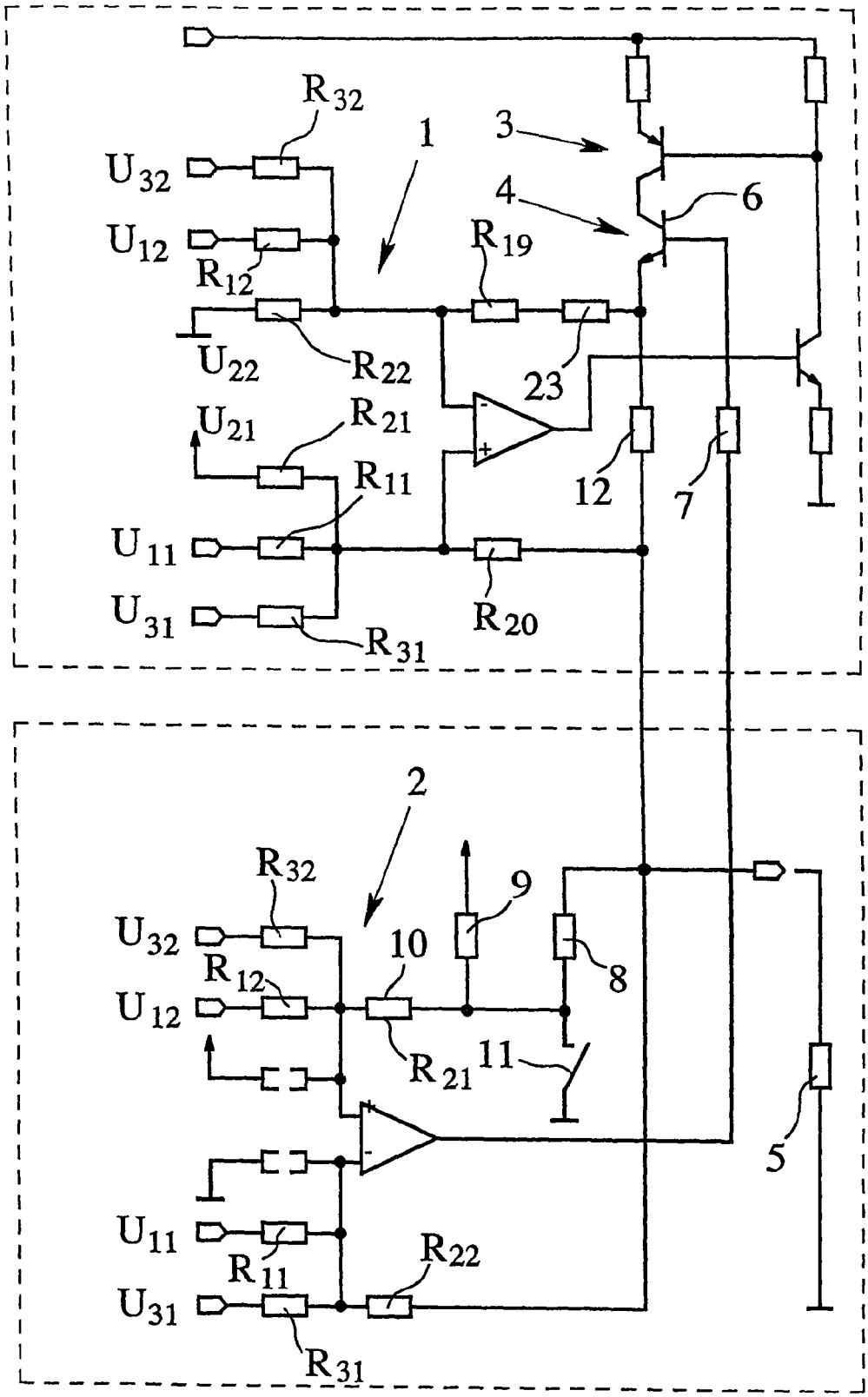
FIG. 2 shows a detailed representation of a preferred embodiment of a circuit arrangement in accordance with the present invention.

As shown schematically in FIG. 1 and in FIG. 2, the current output source 3 and the voltage output source 4 are triggered in parallel and are series-connected on the output side. By triggering the current output source 3 and the voltage output source 4 in parallel, the current output source 3 and the voltage output source 4 are always triggered, the current output source 4 by the current control unit 1, and the voltage output source 4 by the voltage control unit 2, regardless of whether an analog current output value or an analog voltage output value is to be generated.

In FIG. 1, the illustrated embodiment of a circuit arrangement of the present invention employs current control unit 1 and voltage control unit 2 as operational amplifiers. Additionally, current output source 3 and voltage output source 4 each have one output transistor. In FIG. 1, the current output source 3 is shown generically as a current source, while in FIG. 2, both the current output source 3 and the voltage output source 4 each include an output transistor, and both the current output source 3 and the voltage output source 4 are output transistors.

In a preferred embodiment shown in FIG. 2, to generate the current output value, the voltage output source 4 is turned on. The output transistor voltage output source 4 is conductive as an electronic switch. If the circuit arrangement of the present invention is used to generate an analog voltage output value, the current made available from the current output source 3 is that current which flows via the load resistor 5 as current that is independent of external load resistor 5. Alternatively, when a voltage output value is generated, the illustrated circuit arrangement at the voltage output source 4 on the output side must make available the analog voltage output value essentially independent of the external load resistor 5. Consequently, the internal resistance of the voltage output source 4, viewed from the outside, must therefore be small compared to the external load resistance 5. This is the situation for the embodiment of the circuit arrangement of the present invention that is shown in FIG. 2, when the resistance value of the external load resistor 5 is not less than 2kΩ.

In the preferred embodiment of the circuit arrangement shown in FIG. 2, the voltage output source 4 is made as an in-phase controlling class A amplifier with an output transistor 6, a base resistor 7, and a pull-down resistor 8. To generate the current output value, the pull-down resistor 8 of the voltage output source 4 is "run up" via a first series resistor 9. That is, it is brought to a potential that is high relative to the reference potential, so that the voltage control unit 2, an operational amplifier, is overdriven up to a positive end stop, and the output transistor 6 is conductively turned on via the base resistor 7. Thus, essentially only the current output source 3 is active. The voltage output source 4 acts like a conductive switch. To generate a voltage output value, the noninverting input of the operational amplifier that drives the voltage control unit 2 is placed at the reference potential via a second series resistor 10 and a conductive selector switch 11.

In the preferred embodiment of the circuit arrangement shown in FIG. 2, the function of the selector switch 11 determines whether the current output value or the voltage output value is generated. With a nonconductive selector switch 11, a current output value is generated. With a conductive selector switch 11, a voltage output value is generated.

FIG. 2 depicts a preferred embodiment of the circuit arrangement of the present invention including a shunt resistor 12 in series with the current output source 3 and the voltage output source 4. In this configuration, the impressed base current is taken into account at the same time. Shunt resistor 12 is supported on the load resistor 5 and results in current output source 3 remaining roughly in the 12 volt range. As such, a JFET operational amplifier with a supply voltage in the 16 volt range may be used.

As also shown in FIG. 2, operational amplifiers that form current control unit 1 and voltage control unit 2 are made as symmetrical differential amplifier stages. Here, the input value $U_{11}$, the input base value $U_{21}$, and the input correction value $U_{31}$, together with their respective reference potentials $U_{12}$, $U_{22}$, and $U_{32}$, are value pairs that are supplied via identically paired input resistors $R_{11}$ and $R_{12}$, $R_{21}$ and $R_{22}$, as well as $R_{31}$ and $R_{32}$, to the noninverting inputs and the inverting inputs of the operational amplifiers. Otherwise, the feedback resistors $R_{19}$ and $R_{20}$ and $R_{21}$ and $R_{22}$, which belong to the operational amplifiers 1, 2 are likewise made identically paired and symmetrical.

The above described implementation of the input resistors $R_{11}$, $R_{21}$, $R_{31}$, $R_{12}$, $R_{22}$, $R_{32}$, and of the feedback resistors $R_{19}$, $R_{20}$, $R_{21}$, $R_{22}$, results in any number of input values that may be supplied without changing the effective gain, that is, the ratio of the output values to the individual input values. Otherwise, the illustrated and described symmetry ensures the independence of the individual input values from one another and independence from the reference potential.

The preferred embodiment of the circuit arrangement shown in FIG. 2 shows an additional feature of the present invention. Unbalance resistor 23 is connected in series to a feedback resistor $R_{19}$ that lies between the output of the operational amplifier that constitutes the current control unit 1 and its inverting input. Thus the "current loss" that arises when the current output value is generated can be compensated by current flowing parasitically into the feedback branch of the voltage control unit 2 depending on the resistance value of the load resistor 5.

While the present invention has been described in connection with a number of exemplary embodiments and implementations, the present invention is not so limited. Rather, the present invention also covers various modifications and equivalent arrangements that would fall within the purview of appended claims.

The claimed invention is:

1. A circuit arrangement for selective generation of an analog current output value or an analog voltage output value as a function of an analog input value, the circuit arrangement comprising:

a current control unit;

a voltage control unit;

a current output source a voltage output source; and means for producing an analog input value from an output from a measuring device that detects a physical quantity as a measured value and sending the analog input value to an input of the current control unit and to an input of the voltage control unit, wherein the current output source is triggered by the current control unit and the voltage output source is triggered by the voltage control unit, wherein the current output source and the voltage output source are triggered in parallel and are connected in series on their output sides, and wherein a selector switch is provided which enables selection of whether said analog current output value or said analog voltage output value is generated by the circuit arrangement.

2. The circuit arrangement of claim 1, wherein the selective generation of an analog current output value or an analog voltage value is also a function of at least one of an input base value and a signed input correction value.

3. The circuit arrangement of claim 1, wherein the current control unit and the voltage control unit are operational amplifiers.

4. The circuit arrangement of claim 2, wherein the current control unit and the voltage control unit are operational amplifiers.

5. The circuit arrangement of claim 1, wherein the current output source and the voltage output source each have one output transistor.

6. The circuit arrangement of claim 1, wherein the voltage output source is turned on to generate the current output value.

7. The circuit arrangement of claim 1, wherein when the analog voltage output value is generated, the current output source makes available a load current that flows over a load resistor.

8. The circuit arrangement of claim 7, wherein the load current is limited by a minimum external load resistor.

9. The circuit arrangement of claim 6, wherein the voltage output source is an in-phase controlling class A amplifier including an output transistor, a base resistor, and a pull-down resistor.

10. The circuit arrangement of claim 9, wherein to generate the analog current output value, the pull-down resistor of the voltage output source is run up via a first series resistor so that the voltage control unit is overdriven up to a positive end stop and the output transistor is conductively turned on via the base resistor.

11. The circuit arrangement of claim 10, wherein the voltage control unit is an operational amplifier.

12. The circuit arrangement of claim 11, wherein to generate the analog voltage output value the noninverting input of the voltage control unit operational amplifier is placed at the reference potential via a second series resistor and a conductive selector switch.

13. The circuit arrangement of claim 1, further including a shunt resistor in series to the series connection of the current output source and the voltage output source.

14. The circuit arrangement of claim 3, wherein the operational amplifiers that form the current control unit and the voltage control unit are symmetrical differential amplifier stages.

15. The circuit arrangement of claim 4, wherein the operational amplifiers that form the current control unit and the voltage control unit are symmetrical differential amplifier stages.

16. The circuit arrangement of claim 14, wherein the analog input value and its respective reference potential is a value pair and is supplied via identical paired input resistors to the noninverting input and the inverting input of the operational amplifiers.

17. The circuit arrangement of claim 15, wherein the analog input value, the input base value, and the input correction value, together with their respective reference potentials, are value pairs and are supplied via identical paired input resistors to the noninverting inputs and the inverting inputs of the operational amplifiers.

18. The circuit arrangement of claim 4, further including identically paired feedback resistors for the operational amplifiers.

19. The circuit arrangement of claim 4, further comprising an unbalance resistor connected in series to a feedback resistor that lies between the output of the operational amplifier that constitutes the current control unit and its inverting input.

20. The circuit arrangement of claim 3, further comprising an unbalance resistor connected in series to a feedback resistor that lies between the output of the operational amplifier that constitutes the current control unit and its inverting input.

21. The circuit arrangement of claim 3, further comprising a selector switch for selecting and determining which of the current output value and the voltage output value is generated by the circuit arrangement.

22. The circuit arrangement of claim 1, wherein the control units are adapted to produce the selected output value as a value that is dependent on the analog input value produced from the measured value output and which has been standardized for further processing.

* * * * *